US006501914B2

(12) United States Patent
Yoshikawa

(10) Patent No.: US 6,501,914 B2
(45) Date of Patent: Dec. 31, 2002

(54) JAM DETECTOR FOR AN IMAGE FIXING APPARATUS

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/947,514

(22) Filed: Sep. 7, 2001

(65) Prior Publication Data

US 2002/0031358 A1 Mar. 14, 2002

(30) Foreign Application Priority Data

Sep. 8, 2000 (JP) ..... 2000-272935
Aug. 3, 2001 (JP) ..... 2001-236002

(51) Int. Cl.[7] ..... G03G 15/00; G03G 15/20
(52) U.S. Cl. ..... 399/18; 399/22; 399/68
(58) Field of Search ..... 399/18, 21, 22, 399/33, 67, 68, 69

(56) References Cited

U.S. PATENT DOCUMENTS 4,362,502 A * 12/1982 Motomura et al. ..... 399/33 X
4,512,649 A * 4/1985 Derimiggio ..... 399/22
4,994,852 A * 2/1991 Matsuuchi et al. ..... 399/33
5,206,694 A * 4/1993 Ohira et al. ..... 399/33
5,402,211 A 3/1995 Yoshikawa ..... 399/331
5,848,319 A * 12/1998 Morigami et al. ..... 399/22
5,850,588 A 12/1998 Yoshikawa ..... 399/327
6,160,974 A 12/2000 Yoshikawa ..... 399/68

FOREIGN PATENT DOCUMENTS

JP 7-287473 10/1995
JP 9-185274 * 7/1997
JP 2001-75418 * 3/2001

* cited by examiner

*Primary Examiner*—Fred L Braun
(74) *Attorney, Agent, or Firm*—Oblon, Spivak, McClelland, Maier & Neustadt, P.C.

(57) ABSTRACT

An image forming apparatus of the present invention includes two temperature sensors each being responsive to the surface temperature of a particular portion of a fixing member. A reference temperature setting section sets a reference temperature value on the basis of the temperatures that are sensed by the two temperature sensors when the surface of the heating member is heated to a preselected temperature by a heat source. A controller calculates an actual temperature value on the basis of the temperatures sensed by the temperature sensors. The controller then compares the actual temperature value and reference temperature value to thereby determine whether or not a jam ascribable to a recording medium wrapped around the fixing member has occurred. The controller interrupts current supply to the heat source if such a jam has occurred.

46 Claims, 11 Drawing Sheets

JAM DETECTOR FOR AN IMAGE FIXING APPARATUS

BACKGROUND OF THE INVENTION

1. Field of the Invention

The present invention relates to an electrophotographic copier, laser printer, facsimile apparatus or similar image forming apparatus and more particularly to an image forming apparatus capable of detecting a jam that is ascribable to a recording medium wrapped around a heat roller 2. Description of the Background Art An image forming apparatus of the kind described includes a fixing device for fixing a toner image formed on a paper sheet or similar recording medium. The fixing device usually includes a heat roller and a press roller pressed against each other and rotatable to fix the toner image on the paper sheet. The fixing device additionally includes a plurality of peelers for peeling off the paper sheet from the heat roller. The surface of the heat roller is fluoridized for promoting the separation of the tone, which is melted by the heat roller and therefore viscous.

Usually, when a paper sheet jams a path inside the fixing device, the jam is detected on the basis of the output of a sheet sensor responsive to the remaining part of the paper sheet. However, a jam ascribable to a paper sheet wrapped around the heat roller due to defective peeling is not detected. Let this kind of jam be referred to as a wrap jam hereinafter. Such a paper sheet is therefore not removed from the heat roller and causes another wrap jam to occur. More specifically, the operator of the apparatus cannot easily see the paper sheet wrapped around the heat roller and therefore often leaves the former on the latter. Further, the display of a wrap jam can be reset or canceled and therefore causes the wrap jam to repeatedly occur. When the apparatus again starts operating after a stop, the heat roller heats the paper sheet wrapped therearound, resulting in an offensive smell, fume and other troubles.

Japanese Patent Laid-Open Publication No. 7-31933, for example, proposes to cope with a wrap jam by using a reflection type sensor responsive to the quantity of reflection from the surface of the heat roller. An arrangement for sensing the quantity of reflection or ultraviolet ways has also been proposed in the past. The problem with these prior art schemes is that reflectance depends on the color of paper sheets used and is apt to bring about detection errors. Another problem is that the use of a reflection type sensor or ultraviolet rays increases the cost of the apparatus.

Technologies relating to the present invention are also disclosed in, e.g., Japanese Patent Laid-Open Publication No. 7-287473.

SUMMARY OF THE INVENTION

It is an object of the present invention to provide an image forming apparatus capable of easily, surely detecting a wrap jam and a jam occurred in a fixing device with a low-cost configuration, and preventing such jams from repeatedly occurring.

In accordance with the present invention, in an image forming apparatus including a fixing device for fixing a toner image formed on a recording medium, the fixing device includes a rotatable fixing member configured to contact the toner image formed on the recording medium, and a pressing member pressed against the fixing member for conveying the recording medium, cooperation with the fixing member. A heat source heats the fixing member. A first temperature sensor senses the temperature of the surface of the fixing member in a contact range in which the fixing member is expected to contact the recording medium. A second temperature sensor senses the temperature of the surface of the fixing member in a non-contact range outside of the contact range. A controller controls current supply to the heat source in accordance with the temperature sensed by at least the first temperature sensor. A reference temperature setting section sets a reference temperature value on the basis of the temperatures that are sensed by the first and second temperature sensors when the surface of the fixing member is heated to a preselected temperature by the heat source. The controller calculates an actual temperature value on the basis of the temperatures that are sensed by said temperature sensors when the surface of the fixing member is heated to the preselected temperature. The controller then compares the actual temperature value and reference temperature value to thereby determine whether or not a jam ascribable to the recording medium wrapped around the fixing member has occurred. Subsequently, the controller interrupts the current supply to the heat source if the jam has occurred.

BRIEF DESCRIPTION OF THE DRAWINGS

The above and other objects, features and advantages the present invention will become more apparent from the following detailed description taken with the accompanying drawings in which:

FIG. 7 is a flowchart demonstrating a procedure to be executed when the apparatus of FIG. 1 is switched on;

DESCRIPTION OF THE PREFERRED EMBODIMENTS

Figure 1:
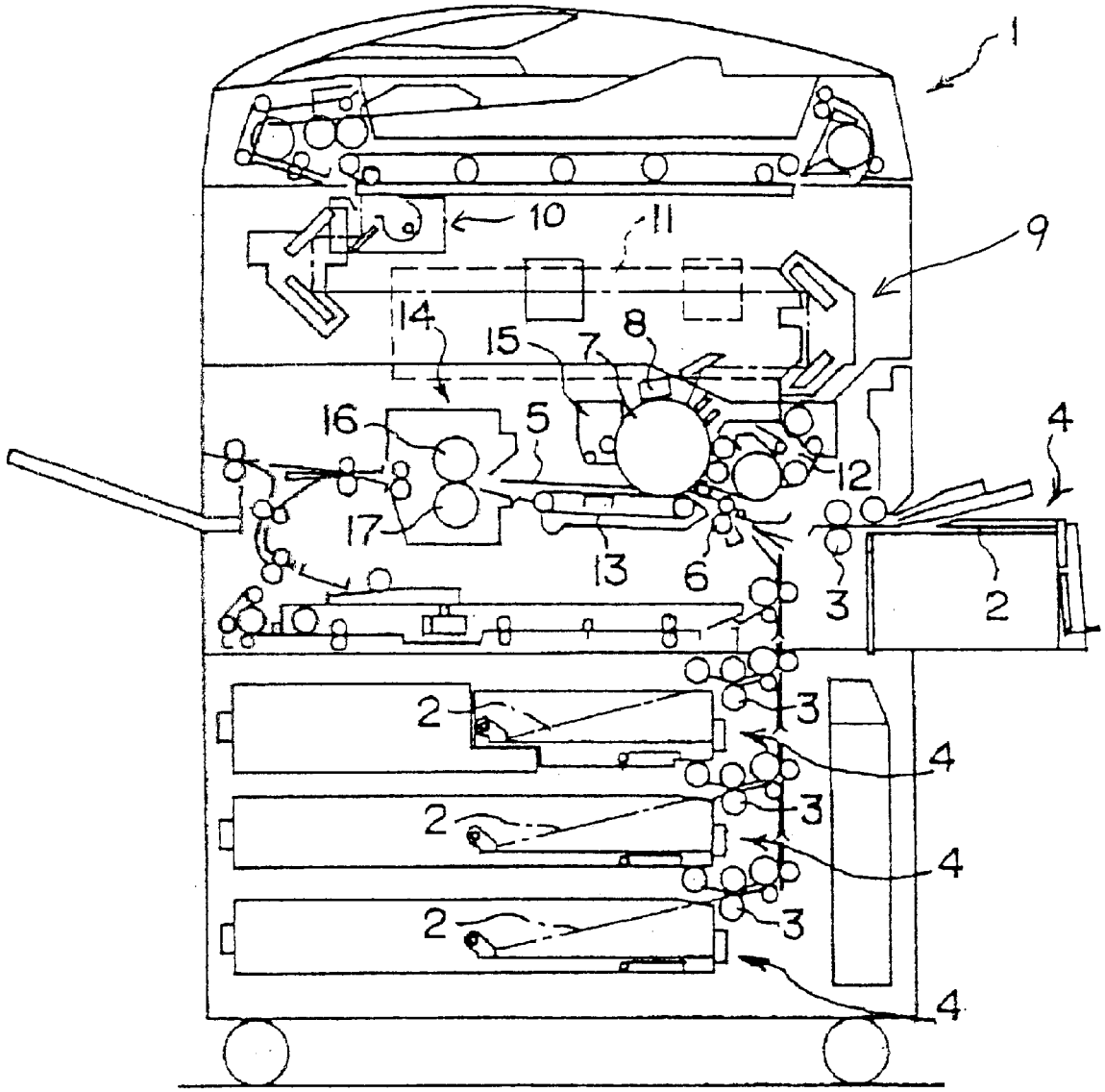
FIG. 1 is a vertical section showing an image forming apparatus to which the present invention is applied.

Referring to FIG. 1 of the drawings, an image forming apparatus to which the present invention is applied is shown. As shown, the image forming apparatus includes a body 1 on which a plurality of sheet feeding devices 4 are mounted. The sheet feeding devices 4 each include a sheet cassette 2 and a pickup roller 3. The pickup roller 3 associated with any one of the sheet cassettes 2 pays out a paper sheet or similar recording medium 5 toward a registration roller pair 6. The registration roller pair 6 stops the paper sheet 5 and then drives it to a photoconductive drum 7 at a preselected timing. A charger 8 uniformly charges the surface of the drum 7 that is rotating clockwise. An image reading device 9 includes a scanner 10 for reading imgewise light reflected from a document. Image data output from the scanner 10 is processed and when input to laser optics 11. The laser optics 11 forms a latent image on the charged surface of the drum 7 with a laser beam in accordance with the image data. A developing device 12 develops the latent image with a developer (toner) to thereby form a corresponding toner image. The toner image formed on the drum 7 is transferred to the paper sheet 5. A belt conveyor 13 conveys the paper sheet 5 with the toner image to a fixing device 14. The fixing device fixes the toner image on the paper sheet 5. A cleaning roller 15 removes the toner left on the drum 7 after the image transfer.

Figure 2:
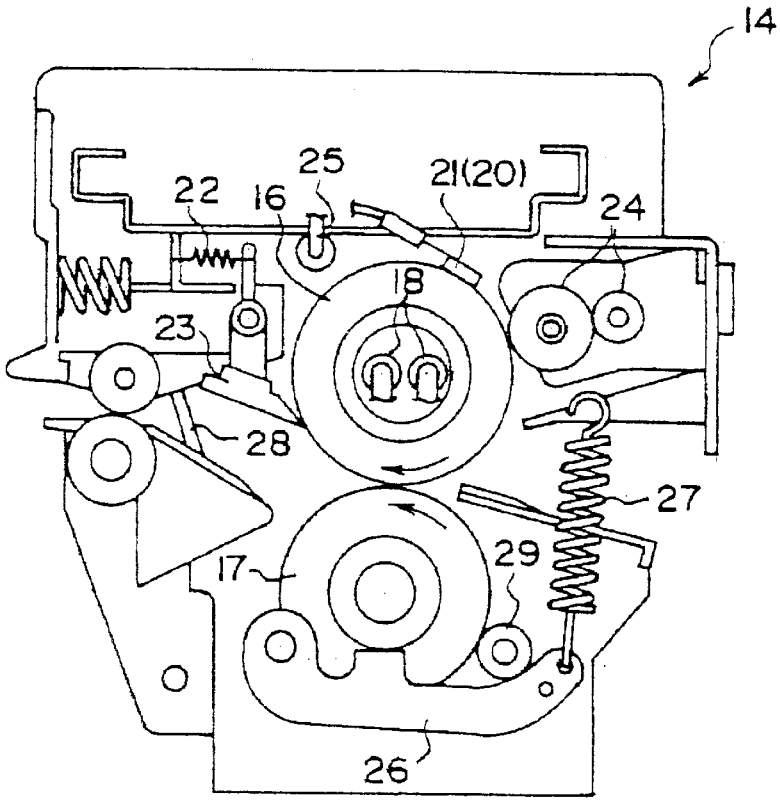
FIG. 2 is a view showing a fixing device included in the apparatus of FIG. 1.

As shown in FIG. 2 specifically, the fixing device 14 includes a heat roller or heating member 16 and a press roller or pressing member 17 dressed against each other. The heat roller 16 accommodates halogen heaters or similar heaters 18 therein. A first and a second temperature sensor 20 and 21 are positioned outside of the heat roller 16 for sensing the surface temperature of the roller 16. The temperature sensor 20 and 21 are implemented by thermistors. The heaters 8 are controlled in accordance with the outputs of the temperature sensor 20 and 21. A plurality of peelers 23 are positioned downstream of the heat roller 16 in a direction of paper conveyance. Each peeler 23 is supported in such a manner as to be angularly movable toward and away from the heat roller 16. The peeler 23 is constantly biased toward the heat roller 16 by a tension spring 22 in order to peel off the paper sheet from the heat roller 16. A temperature fuse 25 interrupts current supply to the fixing device 14 when the device 14 is heated to unusual temperature. A sheet sensor 28 determines whether or not the paper sheet has been driven out and whether or not it is present. A cleaning roller 24 removes excess toner deposited on the heat roller 16.

A lever 26 is angularly movable about a shaft mounted on the apparatus body 1 at one end thereof and supports the press roller 17. A spring 17 is anchored at one end to the apparatus body 1 and at the other end to the other end of the lever 26, constantly biasing the lever 26 toward the heat roller 16. A cleaning roller 29 removes the excess toner deposited on the press roller 17.

The heat roller 16 and press roller 17 fix the toner image on the paper sheet 5 with heat and pressure. The paper sheet 5 with the fixed toner image, i.e., a copy is driven out of the apparatus body 1.

Figure 3:
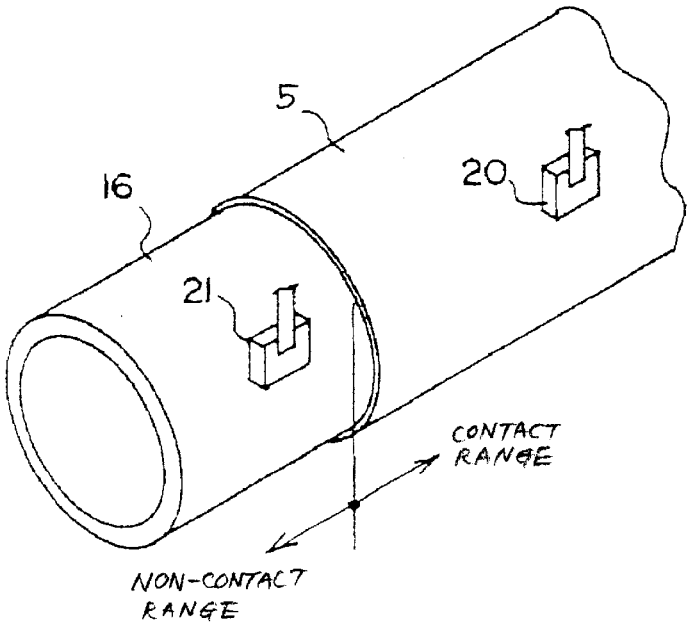
FIG. 3 is a fragmentary isometric view of a heat roller included in the fixing device of FIG. 2.

The present invention is characterized in that it is capable of surely detecting a wrap jam ascribable to a paper sheet wrapped around the heat roller 17. Specifically, as shown in FIG. 3, the first temperature sensor 20 is positioned in the axial, contact range of the heat roller 16 expected to contact the paper sheet 5, i.e., substantially at the center of the roller 16 as viewed in FIG. 3. The second temperature sensor 21 is positioned outside of the above contact range of the heat roller 16, i.e., at either one of opposite end portions of the roller 16. Another temperature sensor 21 may be positioned at the other end portion of the heat roller 16, if desired.

Figure 4:
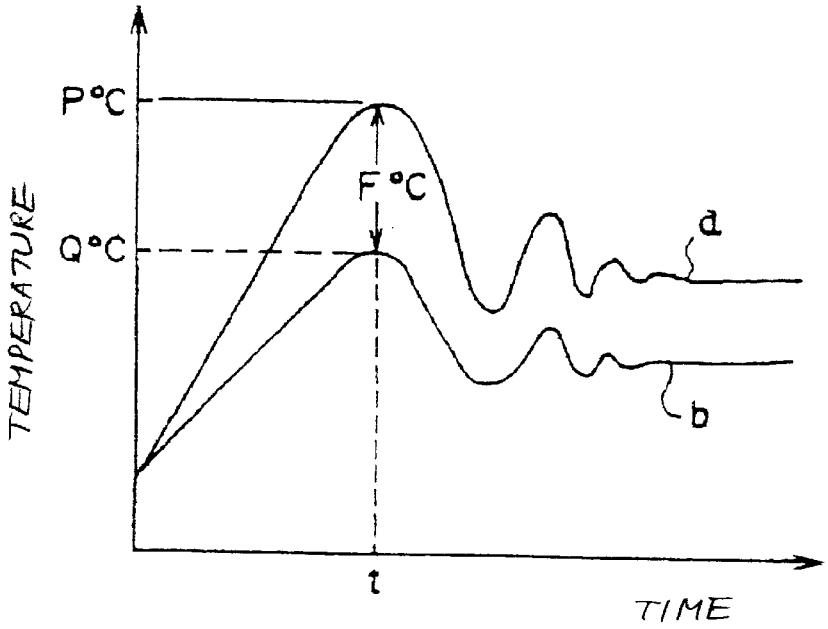
FIG. 4 is a graph showing a relation between the temperature of the heat roller and time.

FIG. 4 is a graph showing a relation between the temperature of the heat roller 16 and time. In FIG. 4, curves a and b are respectively representative of temperature sensed by the first temperature sensor 20 and temperature sensed by the second temperature sensor 21. As shown, the first temperature sensor 20 senses a preselected temperature P° C. at a time t (seconds) . At the time t, the second temperature sensor 21 senses a temperature Q° C. The present invention calculates a difference between the temperatures P° C. and Q° C. (P° C.−Q° C.) beforehand and uses it as a reference temperature value F° C.

Figure 5:
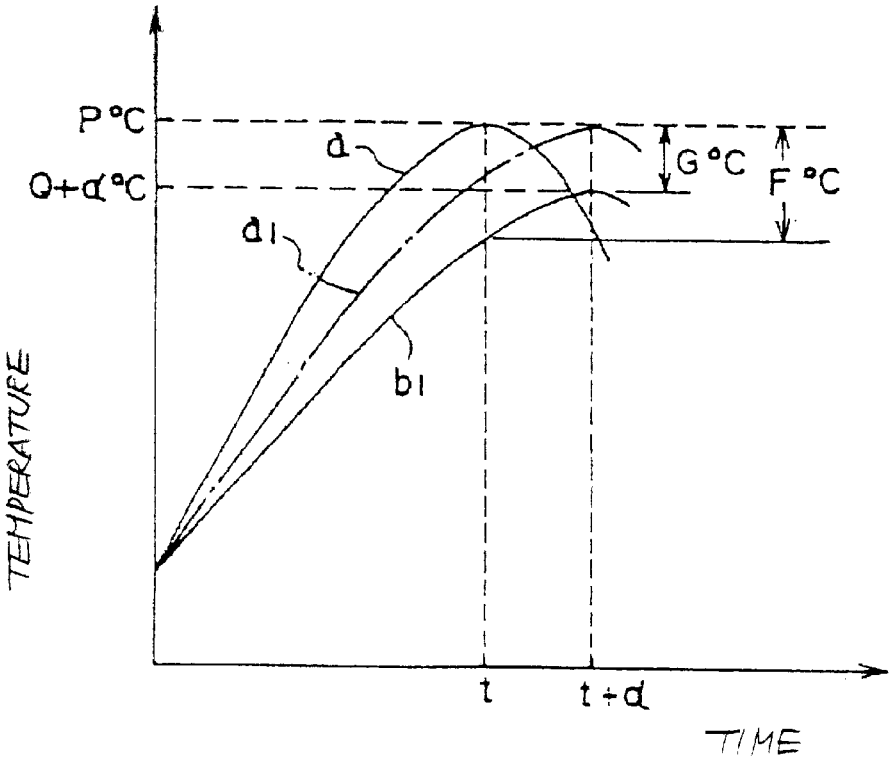
FIG. 5 is a graph showing a relation between the temperature of the heat roller and time to occur in the event of a wrap jam.

FIG. 5 is a graph showing a relation between the temperature of the heat roller 16 and time determined when the paper sheet 5 wrapped around the roller 16. In FIG. 5, curves $a_1$ and $b_1$ are respectively representative of temperature sensed by the first temperature sensor 20 and temperature sensed by the second temperature sensor 21. As the curve $a_1$ indicates, the first temperature sensor 20 measures the temperature of the heat roller 16 via the paper sheet 5 wrapped around the roller 16 and is therefore lowered in response. As a result, the temperature sensor 20 senses the preselected temperature P° C. at a time (t+α), which is later than the time t. By contrast, the second temperature sensor 21, which is located outside of the contact range of the heat roller 16, is free from the influence of the paper sheet 5 wrapped around the roller 16. Therefore, at the time (t+α), the temperature sensor 21 senses a temperature (Q° C.+α) higher than the temperature Q° C. Consequently, a temperature value G° C. at the time (t+α) is smaller than the reference temperature value F° C., i.e., G° C.<F° C.

Paying attention to the facts described above, the present invention measures and records the reference temperature value F° C. beforehand and then determines the actual temperature value G° C. When the actual temperature value G° C. is smaller than the reference temperature value F° C., the present invention determines that a paper sheet has wrapped around the heat roller 16 and jammed the path inside the fixing device 14.

Figure 6:
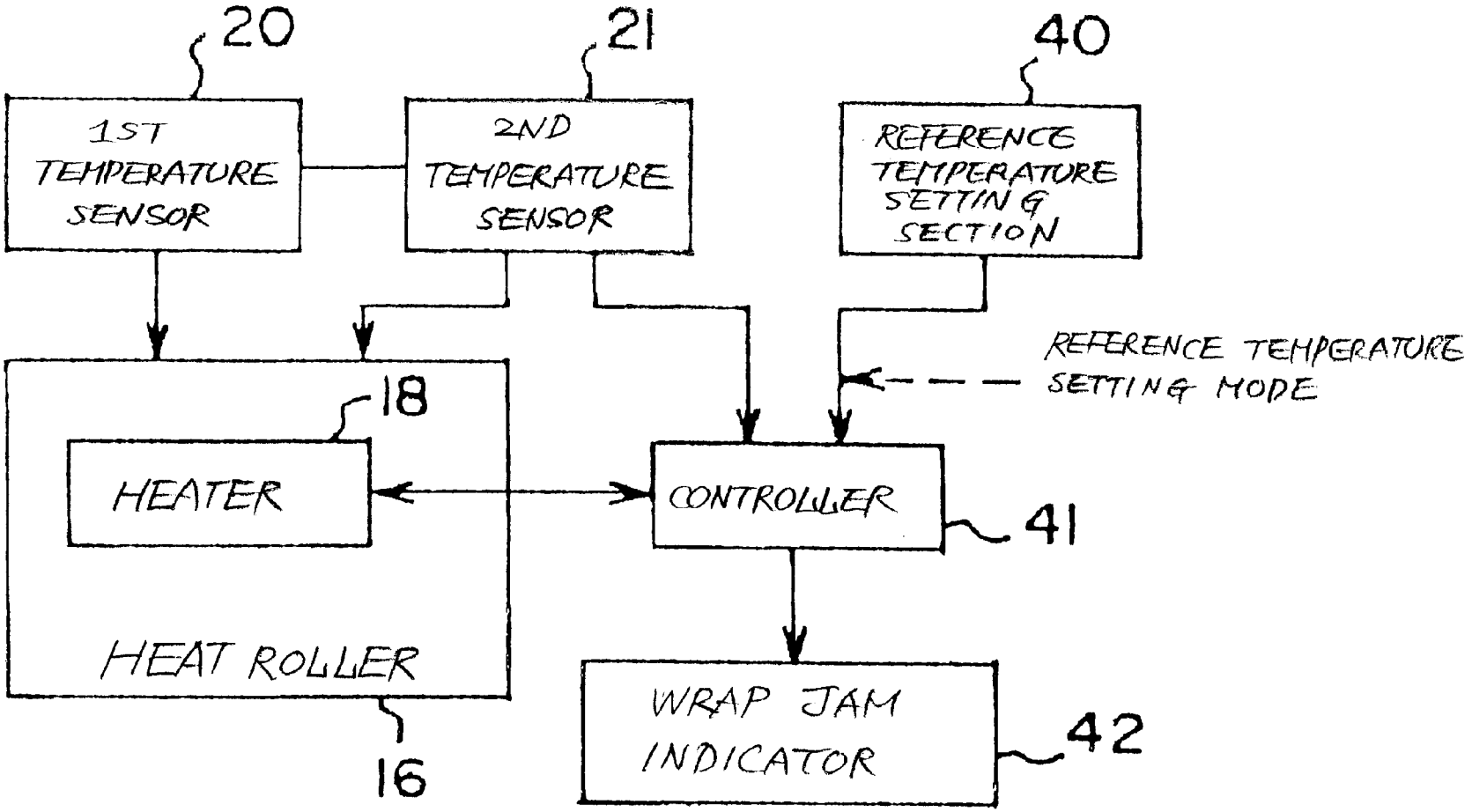
FIG. 6 is a schematic block diagram showing a control system included in the apparatus of FIG. 1.
Figure 7:
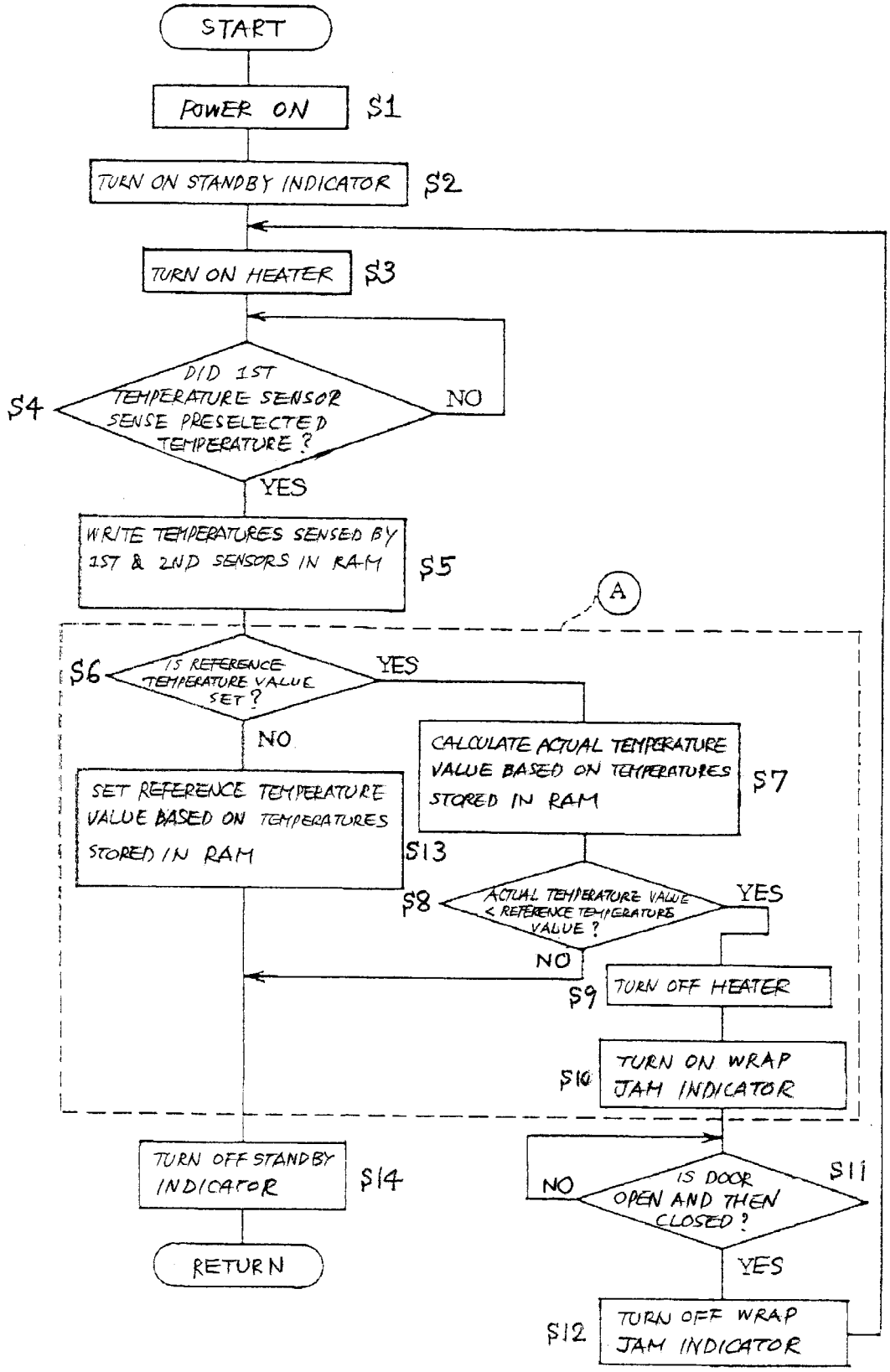
Figure 8:
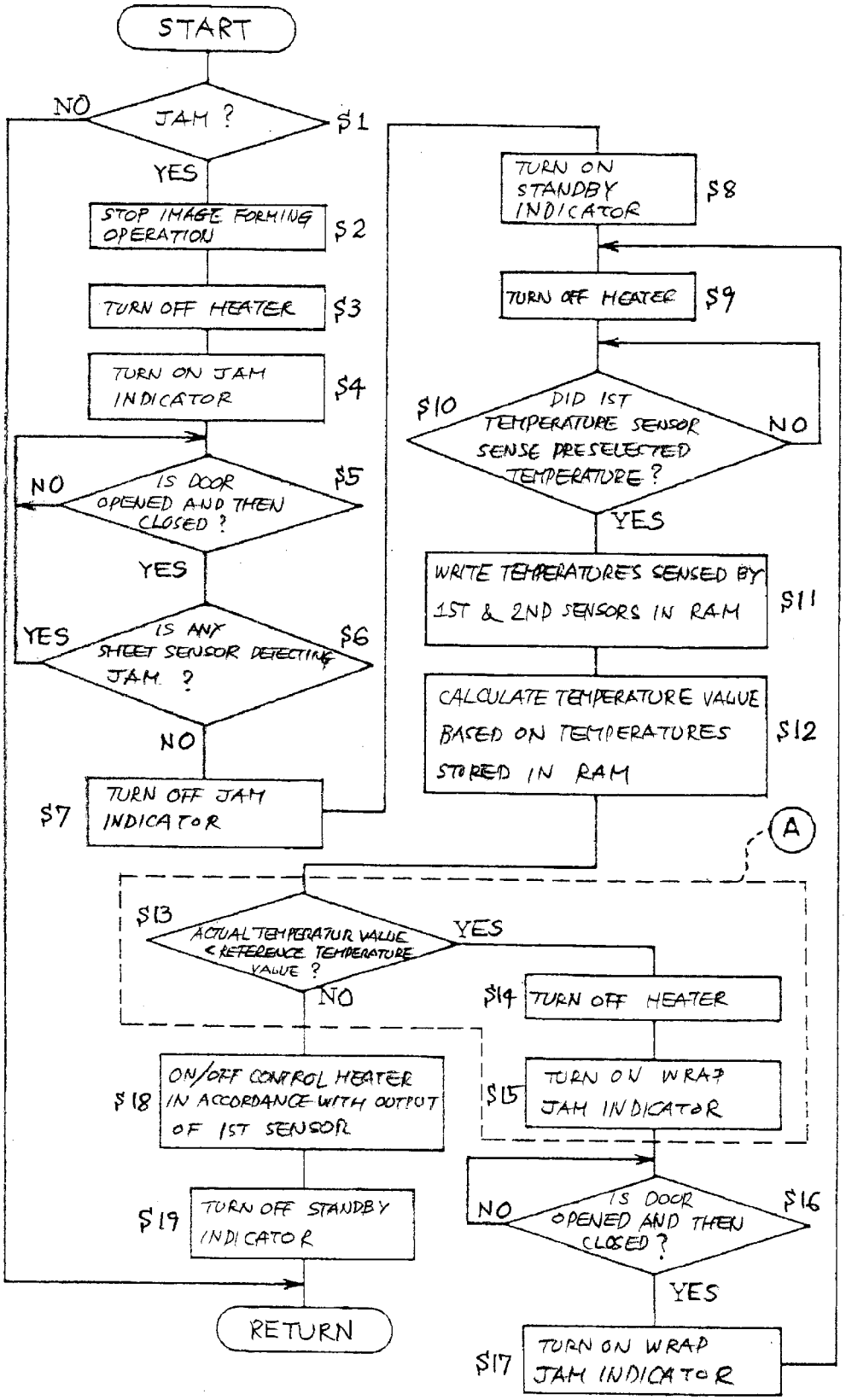
FIG. 8 is a flowchart demonstrating a basic procedure to be executed in the event of a jam.

Reference will be made to FIGS. 6 through 8 for describing the operation of the image forming apparatus. As shown in FIG. 6, a controller 41 controls current supply to each heater 18. When the surface of the heat roller 16 is heated to a preselected temperature, the controller 41 calculates a temperature value on the basis of the temperatures sensed by the first and second temperature sensors 20 and 21.

A reference temperature (REF. TEMP.) setting section 40 allows a reference temperature value to be set on the basis of the temperatures sensed by the two temperature sensors 20 and 21 when the surface of the heat roller 16 reached the preselected temperature. In practice, in accordance with the present invention, a reference temperature value setting mode is executed and set for the first time when the setting section 40 is operated. More specifically, a serviceman sets, changes and confirms the above mode at the time of shipment of the apparatus or at the user's station.

A wrap jam indicator 42 is positioned on an operation panel, not shown, and turns on when the paper sheet 5 wraps around the heat roller 16, as will be described in detail later.

The controller 41 detects the wrapping of the paper sheet 5 around the heat roller 16 on the basis of the temperature value G° C., FIG. 5, derived from the temperature at the time of usual warm-up of the roller 16 (reloading hereinafter) and the temperature at the time of reloading effected with the paper sheet 5 wrapped around the roller 16, as stated earlier. More specifically, the controller 41 accurately senses a temperature difference ascribable to the paper sheet 5 intervening between the heat roller 16 and the first temperature sensor 20. In this respect, it is necessary to exclude voltage variation, irregular light distribution of the heaters 18 and other factors that would cause the temperature of the heat roller 16 to fluctuate.

The reference temperature setting section 40, i.e., the reference temperature value setting mode allows the serviceman to exclude the factors mentioned above. Specifically, a serviceman selects a mode for recording the temperatures sensed by the two sensors 20 and 21 at the time of reloading of the heat roller 16 in the actual environment, e.g., at the user's station. The serviceman selects this mode by hand after switching on the apparatus. If desired, the above mode may be automatically executed when any one of the voltage variation, irregular light distribution and other undesirable factors is detected.

FIG. 8 shows a sequence of steps to be executed by the controller 41 when the paper sheet 5 jams the path inside the apparatus. As shown, the controller 41 first. determines whether or not any one of sheet sensors arranged in the apparatus has sensed a jam (step S1). If the answer of the step S1 is positive (YES), the controller 41 stops the operation of the entire apparatus (step S2) , turns off the heaters 18 (step S3), and displays a jam on the operation panel (step S4). If the answer of the step S1 is negative (NO), the operation simply returns.

After the step S4, the controller 41 determines whether or not a door mounted on the apparatus has been opened and then closed (step S5). If the answer of the step S5 is YES, the controller 41 again determines whether or not any sheet sensor has sensed a jam (step S6). If the answer of the step S6 is NO, the controller 41 cancels the display of a jam on the operation panel (step S7), and then turns on a standby indicator, not shown, on the operation panel (step S8). Further, the controller 41 turns on the heaters 18 in order to start reloading the heat roller 16 to a preselected temperature (step S9). At the same time, the controller 41 causes the first and second temperature sensors 20 and 21 to start sensing the reloading temperature of the heat roller 16.

The controller 41 determines whether or not the first temperature sensor 20 has sensed the preselected temperature (step S10). If the answer of the step S10 is YES, the controller 41 writes the temperatures sensed by the temperature sensors 20 and 21 in a RAM (Random Access Memory), not shown, (step S1). Subsequently, the controller 41 calculates a temperature value on the basis of the temperatures sensed by the temperature sensors 20 and 21 (step S12) and compares it with a reference temperature value (step S13). If the actual temperature value is smaller than the reference temperature value (YES, step S13) , the controller 41 determines that a paper sheet has wrapped around the heat roller 16. The controller 41 then turns off the heaters 18 (step S14) and turns on the wrap jam indicator 42 (step S15). Subsequently, the controller 41 determines whether or not the door has been opened and then closed in order to remove the jamming paper sheet (step S16). If the answer of the step S16 is YES, the controller 41 turns off the wrap jam indicator 42 (step S16) and again executes the routine for reloading the heat roller 16 to the preselected temperature (step S17).

If the answer of the step S13 is NO, meaning that the actual temperature value is greater than the reference temperature value, the controller 41 ON/OFF controls the heaters 18 in accordance with the temperature sensed by the first temperature sensor 20 (step S14). Thereafter, the controller 41 turns off the standby indicator and sets up a ready-to-copy state (step S19).

FIG. 7 demonstrates a procedure to be executed by the controller 41 when the apparatus is switched on. As shown, when the apparatus is switched on (step S1), the controller 41 turns on the standby indicator on the operation panel (step S2) and starts reloading the heat roller 16 to the preselected temperature (step S3). At the same time, the controller 41 causes the temperature sensors 20 and 21 to start sensing the temperature of the heat roller 16. The controller 41 then determines whether or not the temperature sensor 20 has sensed the preselected temperature (step S4). If the answer of the step S4 is YES, the controller 41 writes the temperatures sensed by the temperature sensors 20 and 21 in the RAM or similar storage (step S5).

Subsequently, the controller 41 determines whether or not the reference temperature value has been set (step S6). If the answer of the step S6 is YES, the controller 41 calculates an actual temperature value on the basis of the temperatures by the temperature sensors 20 and 21 (step S7) and then compares it with the reference temperature value (step S8) if the actual temperature value is smaller than the reference temperature value (YES, step S8), the controller 41 turns off the heaters 8 (step S9) and turns on the wrap jam indicator 42 on the operation panel (step S10). After the step S10, the controller 41 determines whether or not the door has been opened and then closed (step S11). If the answer of the step S11 is YES, the controller 41 turns off the wrap jam indicator 42 (step S12) and again starts the routine for reloading the heat roller 16 to the preselected temperature.

If the answer of the step S6 is NO, meaning that the reference temperature value has not been set, the controller 41 sets a reference temperature value on the basis of the temperatures sensed by the temperature sensors 20 and 21 and stored in the RAM (step S13) and turns off the standby indicator to thereby set up the ready-to-copy state (step S14).

Illustrative embodiments of the present invention will be described hereinafter with reference to FIGS. 9 through 12. It is to be noted that the flowcharts shown in FIGS. 9 through 12 each correspond to portions FIGS. 7 and 8, which show basic procedures, enclosed by dashed lines (arrow A).

Figure 9:
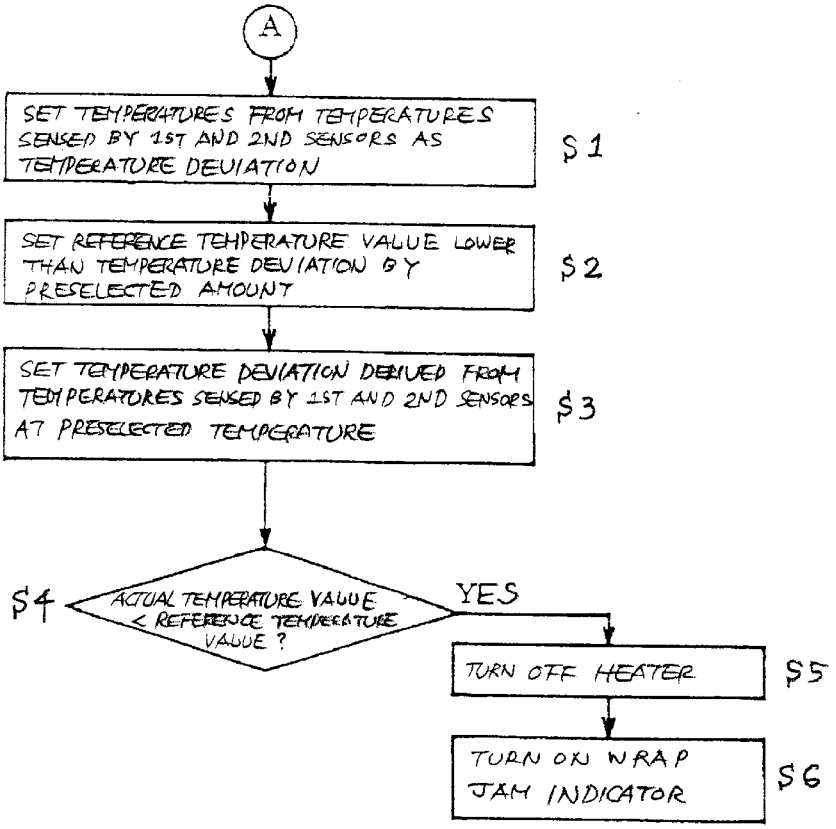
FIGS. 9 through 12, are flowcharts respectively representative of a first to a fourth embodiment of the present invention.

FIG. 9 shows a first embodiment of the present invention characterized in that it uses a temperature difference for decision and provides the reference value with a buffer. As shown, the controller 41 calculates a difference between the temperatures sensed by the temperature sensors 20 and 21 and uses the difference as a deviation (step S1). The controller 41 then sets a reference temperature value smaller than the temperature deviation by a preselected amount as a reference temperature value (step S2). When the temperature sensor 20 reaches the preselected temperature, the controller 41 calculates a deviation between the temperatures sensed by the temperature sensors 20 and 21 as an actual temperature value (S3). The controller 41 then compares the reference temperature value and actual temperature value (step S4). If the actual temperature value is smaller than the reference temperature value (YES, step S4), the controller 41 turns off the heaters 18 (step S5) and turns on the wrap jam indicator 42 on the operation panel (step S6), determining that a paper sheet has wrapped around the heat roller 16.

Figure 10:
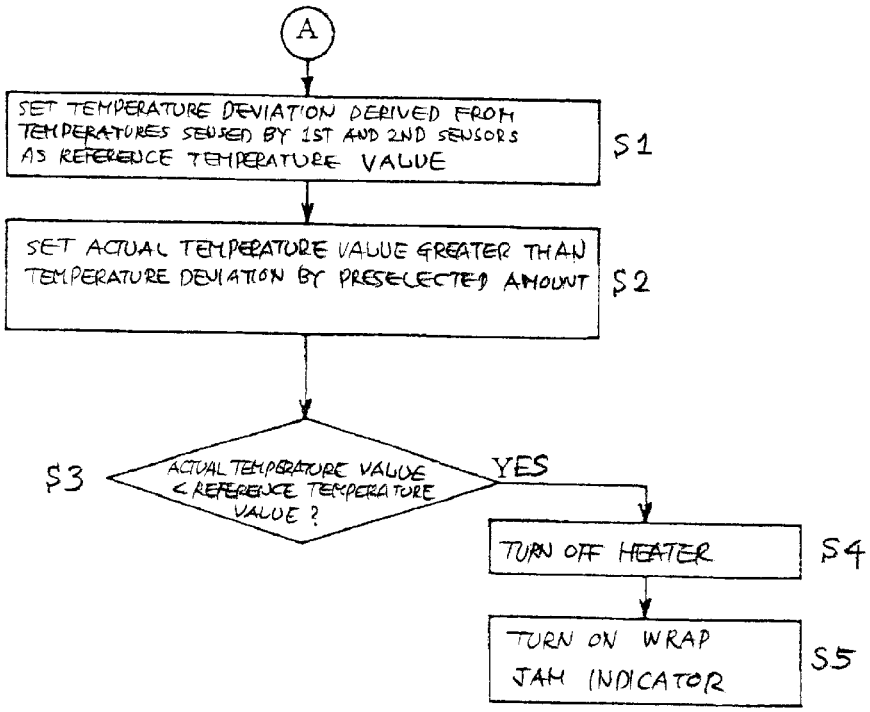

FIG. 10 shows a second embodiment of the present invention characterized in that it uses a temperature deviation for decision and provides the actual temperature value with a buffer. As shown, the controller 41 calculates a difference between the temperatures sensed by the temperature sensors 20 and 21 and uses the difference as a reference temperature value (step S1) . When the temperature sensor 20 reaches the preselected temperature, the controller 41 sets an actual temperature value greater than a temperature deviation derived from the temperatures sensed by the temperature sensors 20 and 21 by a preselected amount (S2) The controller 41 then compares the reference temperature value and actual temperature value (step S3). If the actual temperature value is smaller than the reference temperature value (YES, step S3), the controller 41 turns off the heaters 18 (step S4) and turns on the wrap jam indicator 42 on the operation panel (step S5), determining that a paper sheet has wrapped around the heat roller 16.

Figure 11:
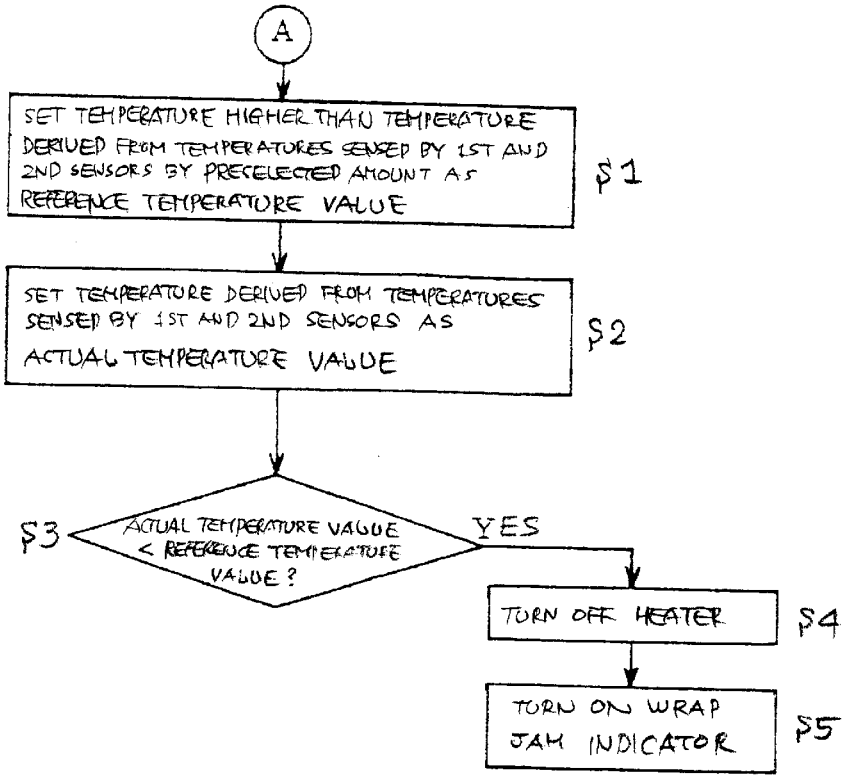

FIG. 11 shows a third embodiment of the present invention characterized in that it uses a temperature for decision and provides the reference value with a buffer. As shown, the controller 41 sets a reference temperature value greater than a temperature derived from the temperatures sensed by the temperature sensors 20 and 21 by a preselected amount (step S1) When the temperature sensor 20 senses the preselected temperature, the controller 41 produces a temperature from the temperatures sensed by the temperature sensors 20 and 21 as an actual temperature value (step S2). Subsequently, the controller 41 compares the reference temperature value and actual temperature value (step S3). If the actual temperature value is greater than the reference temperature value (YES, step S3), the controller 41 turns off the heaters 18 (step S4) and turns on the wrap jam display 42 on the operation panel (step S5), determining that a paper sheet has wrapped around the heat roller 16.

Figure 12:
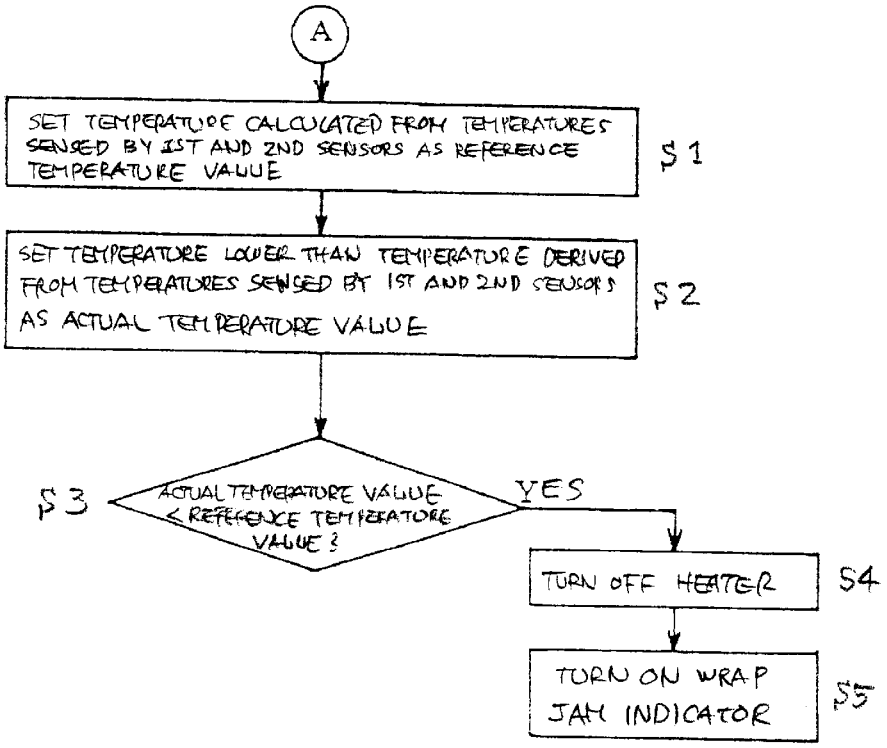

FIG. 12 shows a fourth embodiment of the present invention characterized in that it uses a temperature for decision and provides the actual temperature value with a buffer. As shown, the controller 41 uses a temperature derived from the temperatures sensed by the temperature sensors 20 and 21 as a reference temperature value (step S1). When the temperature sensor 20 senses the preselected temperature, the controller 41 sets a temperature lower than a temperature produced from the temperatures sensed by the temperature sensors 20 and 21 by a preselected amount as an actual temperature value (step S2). Subsequently, the controller 41 compares the reference temperature value and actual temperature value (step S3). If the actual temperature value is greater than the reference temperature value (YES, step S3), the controller 41 turns off the heaters 18 (step S4) and turns on the wrap jam indicator 42 on the operation panel (step S5), determining that a paper sheet has wrapped around the heat roller 16.

Figure 13:
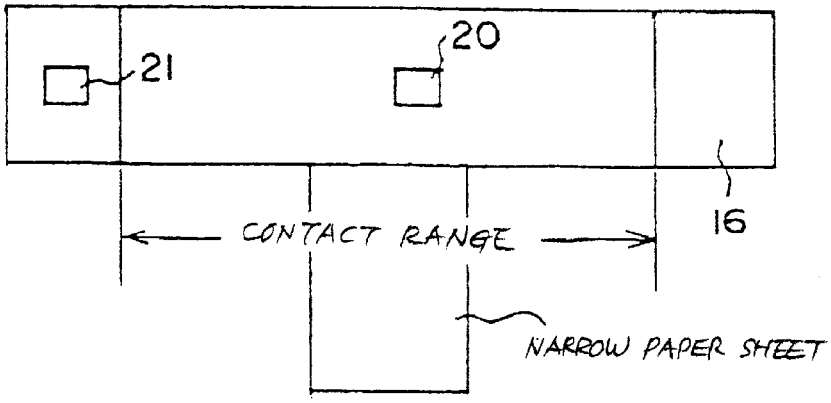
FIG. 13 is a plan view showing a positional relation between the heat roller, temperature sensors and a relatively narrow paper sheet for describing a fifth embodiment of the present invention.
Figure 14:
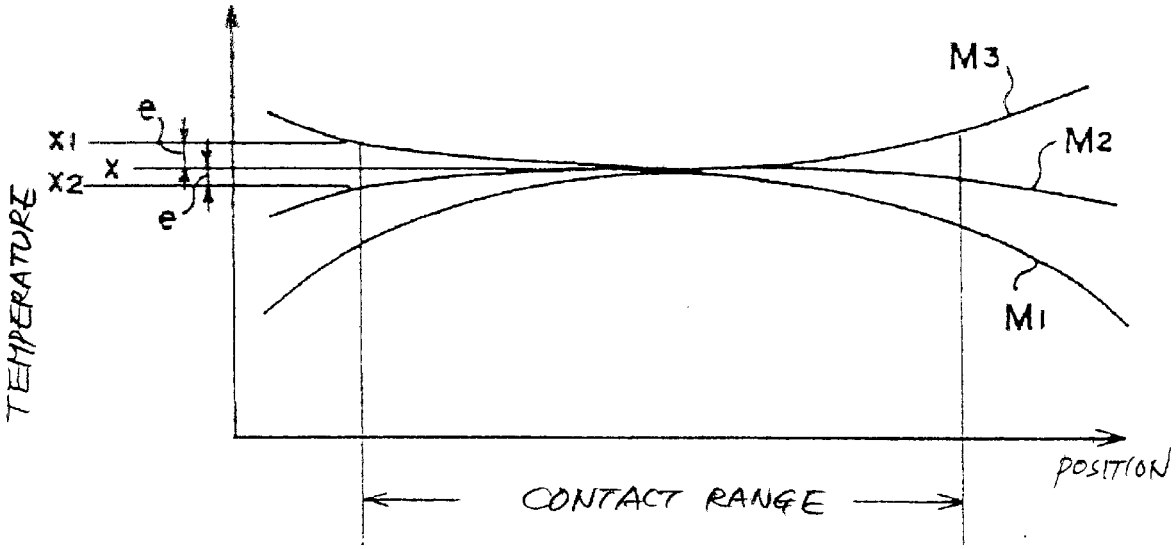
FIG. 14 is a graph showing temperature variations to respectively occur when the apparatus is in a standby state, when paper sheets of maximum size are passed, and when relatively narrow paper sheets are passed.

FIG. 13 is a plan view showing the positional relation between the heat roller 16, temperature sensors 20 and 21 and a relatively narrow paper sheet. FIG. 14 shows a relation between The position of the heat roller 16 and temperature. In FIG. 14, curves $M_1$, $M_2$ and $M_3$ respectively show temperature variation to occur in a standby state, temperature variation to occur when paper sheets of maximum size are passed, and temperature variation to occur when relatively narrow paper sheets are passed. Also, $X_1$ and $X_2$ indicate temperatures sensed at opposite end portions of the heat roller 16 in each of the conditions $M_1$, $M_2$ and $M_3$. Further, letter e indicates the absolute value of a difference by using the case $M_2$ as a reference X.

As FIG. 14 indicates, when relatively narrow paper sheets are continuously passed (condition $M_3$), the temperature of the heat roller 16 is higher at the opposite end portions than at the intermediate portion. The temperature of the heat roller 16 varies at the end portions even in the standby condition M1. More specifically, in the condition M3, the intermediate portion of the heat roller 16 contacts relatively narrow paper sheets continuously fed and therefore looses heat. By contrast, the end portions of the heat roller 16 are heated because they do not contact such paper sheets. As a result, the temperature being sensed by the second temperature sensor 21 rises despite that a wrap jam has not occurred. The temperature value G° C., FIG. 5, is therefore apt to become smaller than the reference temperature value F° C., resulting in an error. A paper sheet wraps around the heat roller 16 in the event of a wrap jam or when the apparatus is switched off and then switched on with a paper sheet wrapping around the roller 16. In light of this, a fifth embodiment of the present invention senses the temperature value G° C. only after jam detection in the fixing device on the basis of correction and setting in the reference value setting mode or in the event of the first reloading effected after the switch-on of the apparatus.

Figure 15:
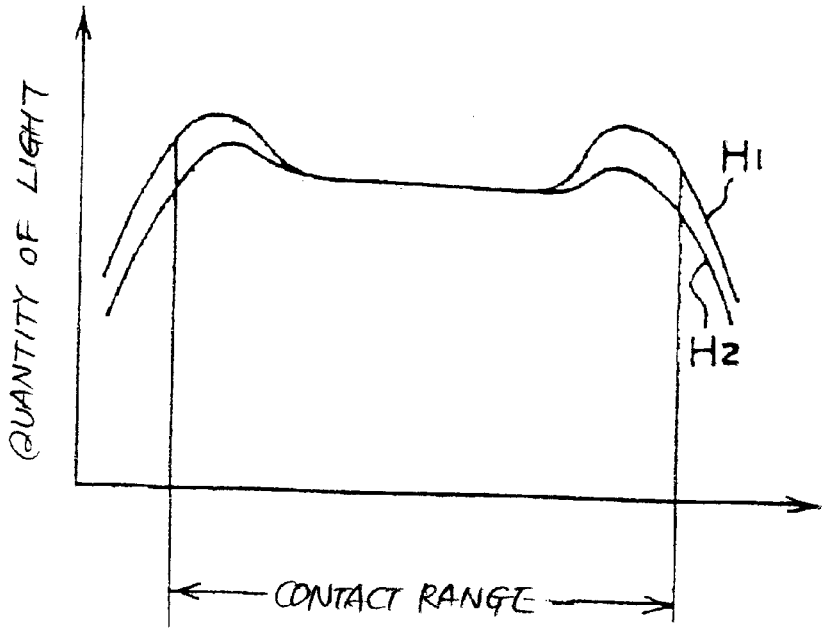
FIG 15 is a graph showing a relation between the light quantity distribution of a heater, which heats the heat roller, and temperature with respect to the range of the heat roller expected to contact a paper sheet.
Figure 16:
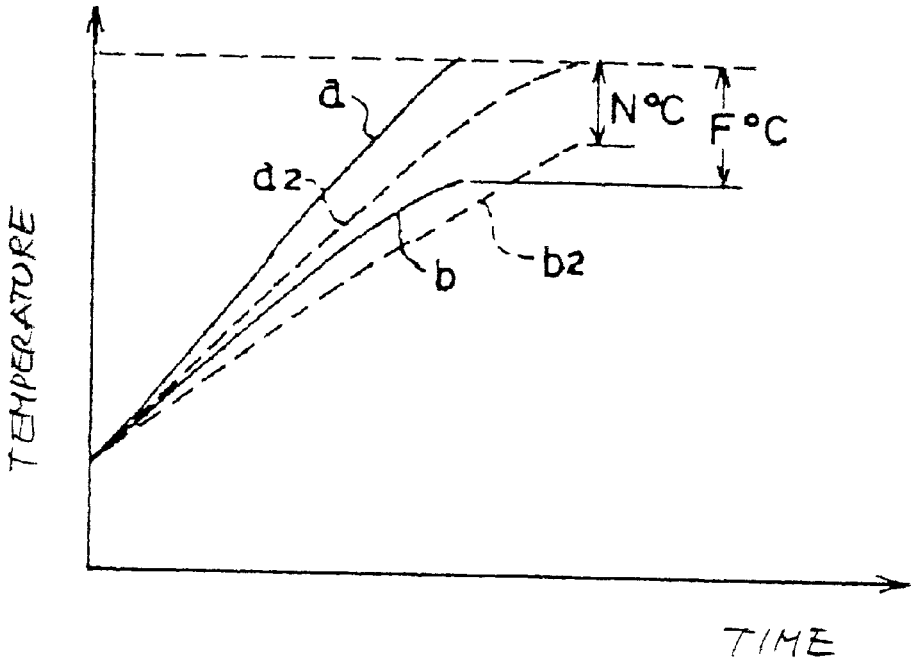
FIG. 16 is a graph showing temperature variations to occur in the event of replacement of the heater for describing a sixth embodiment of the present invention.

Reference will be made to FIGS. 15 and 16 for describing a sixth embodiment of the present invention. In this embodiment, the reference temperature setting section 40 is independent of seating means usually operated to set desired image forming modes. In addition, the reference temperature setting section 40 may be operated to alter the reference temperature value. Specifically, assume that input voltage fluctuates and causes the temperature of the heat roller to vary at the time of warm-up or that any part joining in the control over the fixing temperature is replaced. Then, the reference temperature value is corrected by using temperatures initially sensed by the temperature sensors 20 and 21 as a reference. Thereafter, a temperature value is calculated from the temperatures sensed by the temperature sensors 20 and 21 on the basis of the above reference temperature value.

More specifically, FIG. 15 shows a relation between the light quantity distributions of two heaters H1 and H2 and the contact range of the heat roller 16. As shown, the quantity of light is greater at the end portions of the heat roller 16 than at the intermediate portion. Moreover, the light quantity distribution differs from one heater H1 to the other heater H2. This, coupled with the irregular heat distribution, causes the temperature being sensed by the second temperature sensor 21 to rise despite that a wrap jam has not occurred. This is also apt to reduce the temperature value G° C. and thereby introduce an error in the result of sensing.

For example, assume that a heater is replaced. Then, as shown in FIG. 16, the reference temperature value F° C. is apt to decrease to a reference temperature value N° C. due to a difference in the characteristics of a heater. In FIG. 16, curves $a_2$ and $b_2$ respectively show the variation of temperature sensed by the first temperature sensor 20 and that of temperature sensed by the second temperature sensor 21. Should the control over fixing temperature be executed by using the reference temperature value N° C. as a reference, a wrap jam might be erroneously detected. To solve this problem, when any part joining in the control is replaced, the illustrative embodiment again measures the reference temperature value in the reference value setting mode. Parts joining in the control include the heat roller 16 and temperature sensors 20 and 21 as well as a temperature control board. The factors that make the warm-up temperature of the heat roller 16 irregular additionally include the irregularity of the temperature sensors or thermistors 20 and 21 and devices mounted on a control circuit, irregular wall thickness of the heat roller 16, irregular input voltage, and irregular temperature and humidity (environment). To exclude these factors, too, the reference temperature value setting mode is set at the user's station in accordance with the actual environment, as stated earlier.

Figure 17:
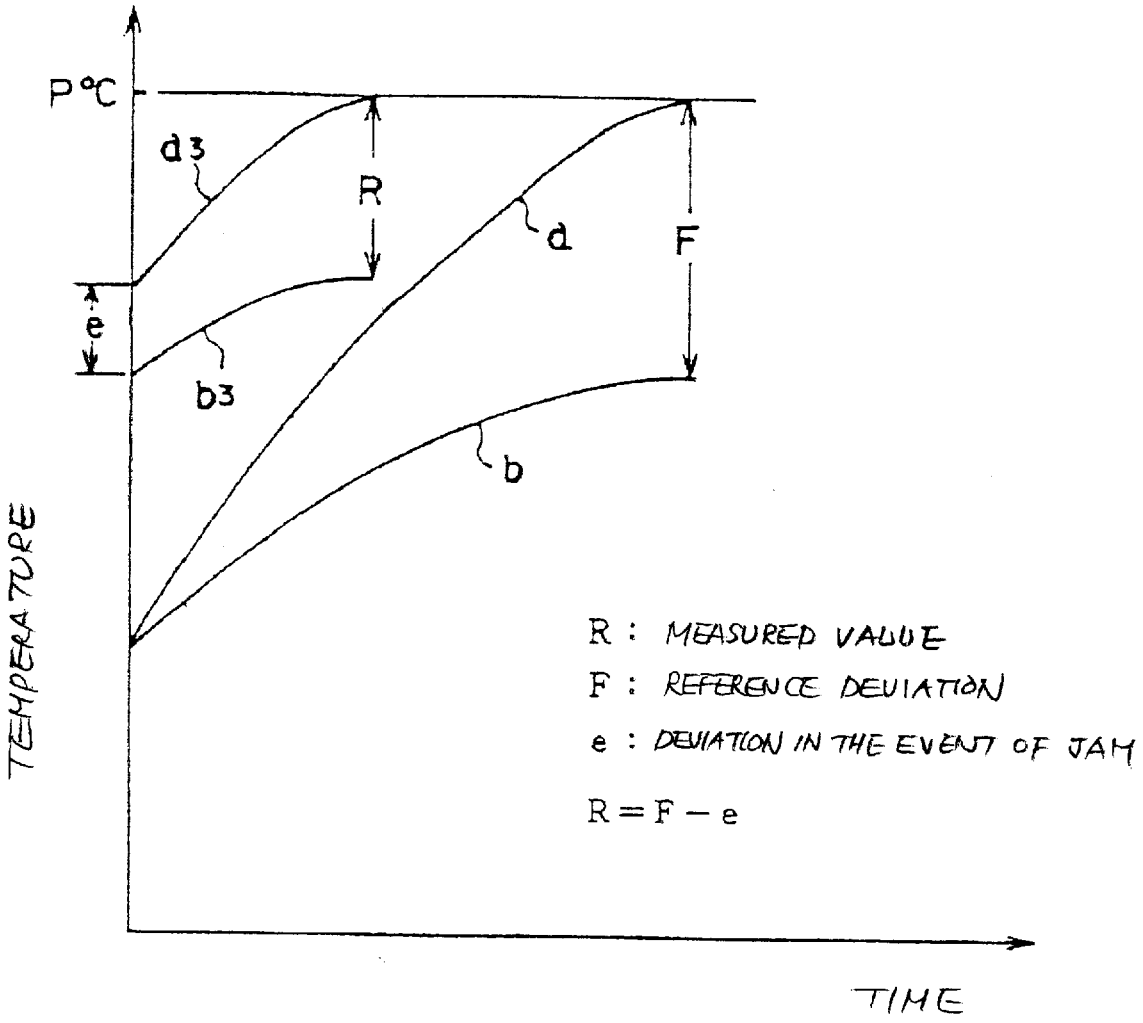
FIG. 17 is a graph showing temperature variations to occur in the event of a jam.

FIG. 17 shows curves $a_3$ and $b_3$ respectively representative of the variations of temperatures sensed by the first and second temperature sensors 20 and 21 in the event of a jam. Letter e indicates a reference temperature value at the beginning of temperature measurement (warm-up) while letter R indicates a value measured in the event of a jam. When paper sheets are continuously fed before jam processing, the temperature being sensed by the second temperature sensor 21 also rises, as stated earlier. Therefore, if jam processing is effected immediately after the continuous feed of paper sheets, it is likely ha a wrap jam is erroneously detected. In light of this, the temperature difference e to occur in the event of a wrap jam may be stored beforehand and added to the reference temperature value F° C. to thereby obviate erroneous detection.

In summary, it will be seen that the present invention provides an image forming apparatus capable of easily, surely detecting a wrap jam and any other jam occurred in a fixing device with a simple configuration, and preventing a jam from occurring again. Further, the apparatus of the present invention allows a reference temperature value to be altered via a reference temperature setting section and thereby obviates detection errors on the basis of a reference temperature value setting mode.

Various modifications will become possible for those skilled in the art after receiving the teachings of the present disclosure without departing from the scope thereof.

What is claimed is:

1. In an image forming apparatus including a fixing device for fixing a toner image formed on a recording medium, said fixing device comprising:

a rotatable fixing member configured to contact the toner image formed on the recording medium;

a pressing member pressed against said fixing member for conveying the recording medium in cooperation with said fixing member;

a heat source configured to heat said fixing member;

first temperature sensing means for sensing a temperature of a surface of said fixing member in a contact range in which said fixing member is expected to contact the recording medium;

second temperature sensing means for sensing a temperature of the surface of sand fixing member in a non-contact range outside of the contact range;

control means for controlling current supply to said heat source in accordance with the temperature sensed by at least said first temperature sensing means; and reference temperature setting means for setting a reference temperature value on the basis of the temperatures that are sensed by said first and second temperature sensing means when the surface of said fixing member is heated to a preselected temperature by said heat source;

wherein said control means calculates an actual temperature value on the basis of the temperatures that are sensed by said first and second temperature sensing means when the surface of said fixing member is heated to the preselected temperature, compares said actual temperature value and said reference temperature value to thereby determine whether or not a jam ascribable to the recording medium wrapped around said fixing member has occurred, and interrupts the current supply to said heat source if said jam has occurred.

2. The apparatus as claimed in claim 1, wherein said reference temperature value set by said reference temperature setting means is smaller than a temperature deviation calculated from the temperatures that are sensed by said first and second temperature sensing means when the surface of said fixing member is heated to the preselected temperature by a preselected amount, said actual temperature value comprises said temperature deviation, and said control means determines that the jam has occurred if said actual temperature value is smaller than said reference temperature value.

3. The apparatus as claimed in claim 2, wherein said reference temperature setting means is independent of setting means for usually allowing an operator to select image forming modes and allows said reference temperature value to be altered thereon.

4. The apparatus as claimed in claim 3, wherein after a jam ascribable to the recording medium staying in a transport path, which is arranged in a body of said apparatus, has been detected or when said heat source warms up said fixing member for the first time after said apparatus has been switched on, said control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

5. The apparatus as claimed in claim 4, wherein said fixing device further comprises:

jam displaying means for displaying a jam ascribable to the recording medium staying in the transport path in said body; and wrap jam displaying means for displaying a wrap jam ascribable to the recording medium wrapped around said fixing member.

6. The apparatus as claimed in claim 1, wherein said reference temperature value comprises a temperature deviation calculated from the temperatures that are sensed by said first and second temperature sensing means when the surface of said fixing member is heated to the preselected temperature, said actual temperature value is greater than said temperature deviation by a preselected amount, and said control means determines that the wrap jam has occurred if said actual temperature value is smaller than said reference temperature value.

7. The apparatus as claimed in claim 6, wherein said reference temperature setting means is independent of setting means for usually allowing an operator to select image forming modes and allows said reference temperature value to be altered thereon.

8. The apparatus as claimed in claim 7, wherein after a jam ascribable to the recording medium staying in a transport path, which is arranged in a body of said apparatus, has been detected or when said heat source warms up said fixing member for the first time after said apparatus has been switched on, said control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

9. The apparatus as claimed in claim 8, wherein said fixing device further comprises:

jam displaying means for displaying a jam ascribable to the recording medium staying in the transport path in said body; and wrap jam displaying means for displaying a wrap jam ascribable to the recording medium wrapped around said fixing member.

10. The apparatus as claimed in claim 1, wherein said reference temperature value is higher than a temperature calculated from the temperatures that are sensed by said first and second temperature sensing means when the surface of said fixing member is heated to the preselected temperature by a preselected amount, said actual temperature value comprises a temperature calculated from the temperatures that are sensed by said first and second temperature sensing means when the surface of said fixing member is heated to the preselected temperature, and said control means determines that the jam ascribable to the recording medium wrapping around said fixing member has occurred if said actual temperature value is greater than said reference temperature value.

11. The apparatus as claimed in claim 10, wherein said reference temperature setting means is independent of setting means for usually allowing an operator to select image forming modes and allows said reference temperature value to be altered thereon.

12. The apparatus as claimed in claim 11, wherein after a jam ascribable to the recording medium staying in a transport path, which is arranged in a body of said apparatus, has been detected or when said heat source warms up said fixing member for the first time after said apparatus has been switched on, said control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

13. The apparatus as claimed in claim 12, wherein said fixing device further comprises:

jam displaying means for displaying a jam ascribable to the recording medium staving in the transport path in said body; and wrap jam displaying means for displaying a wrap jam ascribable to the recording medium wrapped around said fixing member.

14. The apparatus as claimed in claim 1, wherein said reference temperature value comprises a temperature calculated from the temperatures that are sensed by said first and second temperature sensing means when the surface of said fixing member is heated to the preselected temperature, said actual temperature value comprises a temperature lower than the temperature that are sensed by said first and second temperature sensing means when the surface of said fixing member is heated to the preselected temperature by a preselected amount, and said control means determines that the jam ascribable to the recording medium wrapped around said fixing member has occurred if said actual temperature value is greater than said reference temperature value.

15. The apparatus as claimed in claim 14, wherein said reference temperature setting means is independent of setting means for usually allowing an operator to select image forming modes and allows said reference temperature value to be altered thereon.

16. The apparatus as claimed in claim 15, wherein after a jam ascribable to the recording medium staying in a transport path, which is arranged in a body of said apparatus, has been detected or when said heat source warms up said fixing member for the first time after said apparatus has been switched on, said control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

17. The apparatus as claimed in claim 16, wherein said fixing device further comprises:

jam displaying means for displaying a jam ascribable to the recording medium staying in the transport path in said body; and wrap jam displaying means for displaying a wrap jam ascribable to the recording medium wrapped around said fixing member.

18. The apparatus as claimed in claim 1, wherein said reference temperature setting means is independent of seeing means for usually allowing an operator to select image forming modes and allows said reference temperature value to be altered thereon.

19. The apparatus as claimed in claim 18, wherein after a jam ascribable to the recording medium staying in a transport path, which is arranged in a body of said apparatus, has been detected or when said heat source warms up said fixing member for the first time after said apparatus has been switched on, said control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

20. The apparatus as claimed in claim 19, wherein said fixing device further comprises:

jam displaying means for displaying a jam ascribable to the recording medium staying in the transport path in said body; and wrap jam displaying means for displaying a wrap jam ascribable to the recording medium wrapped around said fixing member.

21. The apparatus as claimed in claim 1, wherein after a jam ascribable to the recording medium staying in a transport path, which is arranged in a body of said apparatus, has been detected or when said heat source warms up said fixing member for the first time after said apparatus has been switched on, sand control means calculates said temperature deviation on the basis of the temperatures that are sensed by said first and second temperature sensing means when the surface of said fixing member is heated to the preselected temperature, and compares said temperature deviation and a reference temperature deviation set on said reference temperature setting means.

22. The apparatus as claimed in claim 21, wherein said fixing device further comprises:

jam displaying means for displaying a jam ascribable to the recording medium staying in the transport path in said body; and wrap jam displaying means for displaying a wrap jam ascribable to the recording medium wrapped around said fixing member.

23. The apparatus as claimed in claim 1, wherein said fixing device further comprises:

jam displaying means for displaying a jam ascribable to the recording medium staying in the transport path in sad body; and wrap jam displaying means for displaying a wrap jam ascribable to the recording medium wrapped around said fixing member.

24. In an image forming apparatus including a fixing device for fixing a toner image formed on a recording medium, said fixing device comprising:

a rotatable fixing member configured to contact the toner image formed on the recording medium;

a pressing member pressed against said fixing member for conveying the recording medium in cooperation with said fixing member;

a heat source configured to heat said fixing member;

a first temperature sensor configured to sense a temperature of a surface of said fixing member in a contact range in which said fixing member is expected to contact the recording medium;

a second temperature sensor configured to sense a temperature of the surface of said fixing member in a non-contact range outside of the contact range;

a controller configured to control current supply to said heat source in accordance with the temperature sensed by at least said first temperature sensor; and a reference temperature setting section configured to said a reference temperature value on the basis of the temperatures that are sensed by said first and second temperature sensors when the surface of said fixing member is heated to a preselected temperature by said heat source;

wherein said controller calculates an actual temperature value on the basis of the temperatures that are sensed by said first and second temperature sensors when the surface of said fixing member is heated to the preselected temperature, compares said actual temperature value and said reference temperature value to thereby determine whether or not a jam ascribable to the recording medium wrapped around said fixing member has occurred, and interrupts the current supply to said heat source if said jam has occurred.

25. The apparatus as claimed in calm 24, wherein said reference temperature value set by said reference temperature setting section is smaller than a temperature deviation calculated from the temperatures that are sensed by said first and second temperature sensors when the surface of said fixing member is heated to the preselected temperature by a preselected amount, said actual temperature value comprises said temperature deviation, and said controller determines that the jam has occurred if said actual temperature value is smaller than said reference temperature value.

26. The apparatus as claimed in claim 25, wherein said reference temperature setting section is independent of a setting section for usually allowing an operator to select image forming modes and allows said reference temperature value to be altered thereon.

27. The apparatus as clammed in claim 26, wherein after a jam ascribable to the recording medium staying in a transport path, which is arranged an a body of said apparatus, has been detected or when said heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

28. The apparatus as claimed in claim 27, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

29. The apparatus as claimed in claim 24, wherein said reference temperature value comprises a temperature deviation calculated from the temperatures that are sensed by said first and second temperature sensors when the surface of said fixing member is heated to the preselected temperature, said actual temperature value is greater than said temperature deviation by a preselected amount, and said controller determines that the wrap jam has occurred if said actual temperature value is smaller than said reference temperature value.

30. The apparatus as claimed in claim 29, wherein said reference temperature setting section is independent of a setting section for usually allowing an operator to select image forming modes and allows said reference temperature value to be altered thereon.

31. The apparatus as claimed in claim 30, wherein after a jam ascribable to the recording medium staying in a transport path, which is arranged in a body of said apparatus, has been detected or when said heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

32. The apparatus as claimed in claim 31, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

33. The apparatus as claimed in claim 24, wherein said reference temperature value is higher than a temperature calculated from the temperatures that are sensed by said first and second temperature sensors when the surface of said fixing member is heated to the preselected temperature by a preselected amount, said actual temperature value comprises a temperature calculated from the temperatures that are sensed by said first and second temperature sensors when the surface of said fixing member is heated to the preselected temperature, and said controller determines that the jam ascribable to the recording medium wrapping around said fixing member has occurred if said actual temperature value is greater than said reference temperature value.

34. The apparatus as claimed in claim 33, wherein said reference temperature setting section is independent of a setting section for usually allowing an operator to select image forming modes and allows said reference temperature value to be altered thereon.

35. The apparatus as claimed in claim 34, wherein after a jam ascribable to the recording medium staying in a transport path, which is arranged in a body of said apparatus, has been detected or when said heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

36. The apparatus as claimed in claim 35, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

37. The apparatus as claimed in claim 24, wherein said reference temperature value comprises a temperature calculated from the temperatures that are sensed by said first and second temperature sensors when the surface of said fixing member is heated to the preselected temperature, said actual temperature value comprises a temperature lower than the temperature that are sensed by said first and second temperature sensors when the surface of said fixing member is heated to the preselected temperature by a preselected amount, and said controller determines that the jam ascribable to the recording medium wrapped around said fixing member has occurred if said actual temperature value is greater than said reference temperature value.

38. The apparatus as claimed in claim 37, wherein said reference temperature setting section is independent of a setting section for usually allowing an operator to select image forming modes and allows said reference temperature value to be altered thereon.

39. The apparatus as claimed in claim 38, wherein after a jam ascribable to the recording medium staying in a transport path, which is arranged in a body of said apparatus, has been detected or when sa d heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

40. The apparatus as claimed in claim 39, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

41. The apparatus as claimed in claim 24, wherein said reference temperature setting section is independent of a setting section for usually allowing an operator to select image forming modes and allows said reference temperature value to be altered thereon.

42. The apparatus as claimed in claim 41, wherein after a jam ascribable to the recording medium staying in a transport path, which is arranged in a body of said apparatus, has been detected or when said heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

43. The apparatus as claimed in claim 42, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

44. The apparatus as claimed in claim 24, wherein after a jam ascribable to the recording medium staying in a transport path, which is arranged in a body of said apparatus, has been detected or when said heat source warms up said fixing member for the first time after said apparatus has been switched on, said controller calculates said temperature deviation on the basis of the temperatures that are sensed by said first and second temperature sensors when the surface of said fixing member is heated to the preselected temperature, and compares said temperature deviation and a reference temperature deviation set on said reference temperature setting section.

45. The apparatus as claimed in claim 44, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

46. The apparatus as claimed in claim 24, wherein said fixing device further comprises:

a jam indicator configured to display a jam ascribable to the recording medium staying in the transport path in said body; and a wrap jam indicator configured to display a wrap jam ascribable to the recording medium wrapped around said fixing member.

* * * * *